US009144699B1

(12) United States Patent
Wang

(10) Patent No.: US 9,144,699 B1
(45) Date of Patent: Sep. 29, 2015

(54) GAS INLET STRUCTURE FOR A FIRE EXTINGUISHER

(71) Applicant: Chih-Chen Wang, Tainan (TW)

(72) Inventor: Chih-Chen Wang, Tainan (TW)

( * ) Notice: Subject to any disclaimer, the term of this patent is extended or adjusted under 35 U.S.C. 154(b) by 0 days.

(21) Appl. No.: 14/292,871

(22) Filed: May 31, 2014

(51) Int. Cl.

| | |
|---|---|
| ***A62C 35/58*** | (2006.01) |
| ***A62C 13/70*** | (2006.01) |
| ***A62C 13/00*** | (2006.01) |
| ***A62C 13/66*** | (2006.01) |
| ***B05B 11/06*** | (2006.01) |
| ***B05B 7/14*** | (2006.01) |

(52) U.S. Cl.
CPC ..... *A62C 13/70* (2013.01); *A62C 13/003* (2013.01); *A62C 13/006* (2013.01); *A62C 13/66* (2013.01); *B05B 7/1404* (2013.01); *B05B 11/06* (2013.01); *B05B 11/062* (2013.01)

(58) Field of Classification Search
CPC ..... A62C 13/66; A62C 13/006; A62C 13/70; A62C 13/003; B05B 7/1404; B05B 11/06; B05B 11/062; B67D 1/0412
USPC ..... 169/30, 72, 77, 85, 88; 239/650, 654; 222/399
See application file for complete search history.

(56) References Cited

U.S. PATENT DOCUMENTS

| | | | | | |
|---|---|---|---|---|---|
| 2,620,038 | A * | 12/1952 | Somers et al. | ..... | 169/77 |
| 2,680,546 | A * | 6/1954 | Seaberg | ..... | 169/85 |
| 3,149,677 | A * | 9/1964 | Blair | ..... | 169/85 |
| 3,255,824 | A * | 6/1966 | Rodgers | ..... | 169/77 |
| 7,318,484 | B2 * | 1/2008 | Rousseau et al. | ..... | 169/85 |

* cited by examiner

*Primary Examiner* — Steven J Ganey

(57) ABSTRACT

A fire extinguisher includes a body including a chamber receiving fire extinguishing powders. An upper cover includes a gas inlet passage and a gas intake in communication with the gas inlet passage. The upper cover further includes a through-hole aligned with the gas intake. A high-pressure steel bottle is coupled to the upper cover. The spring, when not compressed, holds the piercing needle in the gas intake and the through-hole such that the piercing needle will not pierce into a preserved opening of the high-pressure steel bottle. A pressing rod is pivotably connected to the upper cover. A switch handle is operably connected to the pressing rod. If a pin restraining movement of the switch handle is removed, when switch handle is operated to drive the pressing rod to pivot, the piercing needle is actuated by the pressing rod to pierce into the preserved opening of the high-pressure steel bottle.

10 Claims, 7 Drawing Sheets

GAS INLET STRUCTURE FOR A FIRE EXTINGUISHER

BACKGROUND OF THE INVENTION

The present invention relates to a gas inlet structure for a fire extinguisher and, more particularly, to a gas inlet structure for a fire extinguisher providing improved safety and reliable force-saving operation.

A type of fire extinguisher includes a pressurized steel bottle receiving fire extinguishing powders. In use, a valve can be pressed to output the fire extinguishing powders together with a high-pressure gas to extinguish the fire. However, the pressure inside the steel bottle decreases over time. When the pressure is insufficient, gas must be filled into the steel bottle, leading to inconvenience in maintenance and filling.

To solve the above disadvantages, a high-pressure steel bottle external to the fire extinguisher is provided. The fire extinguisher includes a body receiving fire extinguisher powders. The body includes an outlet and a gas inlet. The high-pressure steel bottle is connected to the gas inlet. A piercing needle and a button are provided to the body in a location corresponding to the high-pressure steel bottle. A protective cover is provided on top of the button and shields the button to prevent inadvertent pressing of the button. In use, the protective cover is opened, and the button is pressed to actuate the piercing needle to pierce into a preserved opening in the high-pressure steel bottle. The gas contained in the high-pressure bottle is guided into the body and carries the fire extinguisher powders out of the body via the outlet to extinguish fire.

However, a force must be applied to actuate the piercing needle to pierce the high-pressure steel bottle, leading to inconvenience to operation as well as unsuccessful operation if the force is too small. Furthermore, the protective cover could be inadvertently opened by a person other than an intended user, leading to exposure of the button and subsequent pressing in error.

BRIEF SUMMARY OF THE INVENTION

An objective of the present invention is to provide a fire extinguisher providing improved safety and reliable force-saving operation.

A fire extinguisher according to the present invention includes a body including a chamber having an opening in an upper end of the body. The chamber is adapted to receive fire extinguishing powders. An upper cover covers the opening of the body and includes an output passage in communication with the chamber. The upper cover further includes a gas inlet passage in communication with the chamber. The upper cover further includes a first coupling portion having a gas intake in communication with the gas inlet passage. The upper cover further includes a second coupling portion including a through-hole aligned with the gas intake. The second coupling portion further includes at least one pivot hole and at least one pin hole. A high-pressure steel bottle includes a top end coupled to the first coupling portion. The high-pressure steel bottle is adapted to receive a high pressure gas. The high-pressure steel bottle includes a preserved opening aligned with the gas intake.

A gas intake control unit includes a check valve mounted in the gas inlet passage of the upper cover. The check valve is adapted to prevent the gas from flowing through the gas inlet passage in a reverse direction. A piercing needle is mounted in the gas intake of the first coupling portion and the through-hole of the second coupling portion. The piercing needle includes a needle on a bottom end thereof. The needle is adapted to pierce into the preserved opening of the high-pressure steel bottle. The piercing needle further includes an abutment portion on a top end thereof. The abutment portion extends upward beyond the through-hole of the second coupling portion. A spring holds the piercing needle such that the needle of the piercing needle will not pierce into the preserved opening of the high-pressure steel bottle when the spring is not compressed. A pressing rod includes a shank pivotably connected to the at least one pivotal hole of the second coupling portion. The shank includes a pressing portion for pressing against the abutment portion of the piercing needle. A switch handle includes a holding portion located outside of the upper cover. The switch handle further includes at least one side portion operably connected to the pressing rod, with the holding portion spaced from the shank of the pressing rod. A pin extends through the at least one pin hole to restrain movement of the switch handle. If the pin is removed, when the holding portion of switch handle is operated to drive the pressing rod to pivot, the piercing needle is actuated by the pressing portion to pierce into the preserved opening of the high-pressure steel bottle.

In an embodiment, the first coupling portion is located below the gas inlet passage in a vertical direction perpendicular to the horizontal direction. The second coupling portion is located above the gas intake of the first coupling portion in the vertical direction. The second coupling portion includes two sidewalls parallel to each other and a bottom wall extending between the sidewalls. The through-hole of the second coupling portion is located in the bottom wall. The at least one pivotal hole includes two pivotal holes respectively located in the sidewalls. The at least one pin hole includes two pin holes respectively located in the sidewalls. Each pivotal hole is located between one of the pin holes and the body.

In the embodiment, the pressing portion of the pressing rod includes an arcuate side on an outer edge thereof, and the needle of the piercing needle includes a recessed gas passage in a side thereof.

In the embodiment, the gas intake control unit further includes a stop. The spring includes a bottom end abutting the bottom wall of the second coupling portion. The spring further includes a top end abutting the stop. The stop includes a through-hole through which the piercing needle extends. The through-hole of the stop has a diameter smaller than a width of the abutment portion of the piercing needle. The spring abuts the stop and the piercing needle, preventing the needle from piercing into the preserved opening of the high-pressure steel bottle when the spring is not compressed.

In the embodiment, the pressing rod further includes two end seats respectively mounted to outer sides of the sidewalls of the second coupling portion and aligned with the pivotal holes of the sidewalls of the second coupling portion. Each end seat includes a coupling groove. The shank includes two ends respectively extending through the pivotal holes of the sidewalls of the second coupling portion and respectively coupled to the end seats. The at least one side portion of the switch handle includes two side portions respectively coupled to the coupling grooves of the end seats. The side portions of the switch handle are normally located below the pin holes. The pin is located above the switch handle.

In the embodiment shown, the gas inlet passage includes an opening. The gas intake control unit further includes a pressure gauge mounted in and sealing the opening of the gas inlet passage.

In the embodiment shown, the body further includes a guiding tube mounted in a central portion of the chamber. The guiding tube includes a lower end having an inlet. The upper cover includes an inner tube in a lower end thereof. The inner tube is in communication with the guiding tube. The output passage of the upper cover is in communication with the inner tube and the chamber. The output passage includes an outlet. An output tube has an end connected to the outlet. A valve is mounted in the output tube.

In the embodiment shown, the upper cover further includes a handle on an upper end thereof.

In the embodiment shown, the second coupling portion further includes a drain in front of the bottom wall.

In the embodiment shown, the spring is surrounded by an annular dustproof sleeve made of soft material and located between the stop and the bottom wall of the second coupling portion.

The present invention will become clearer in light of the following detailed description of illustrative embodiments of this invention described in connection with the drawings.

DETAILED DESCRIPTION OF THE INVENTION

Figure 1:
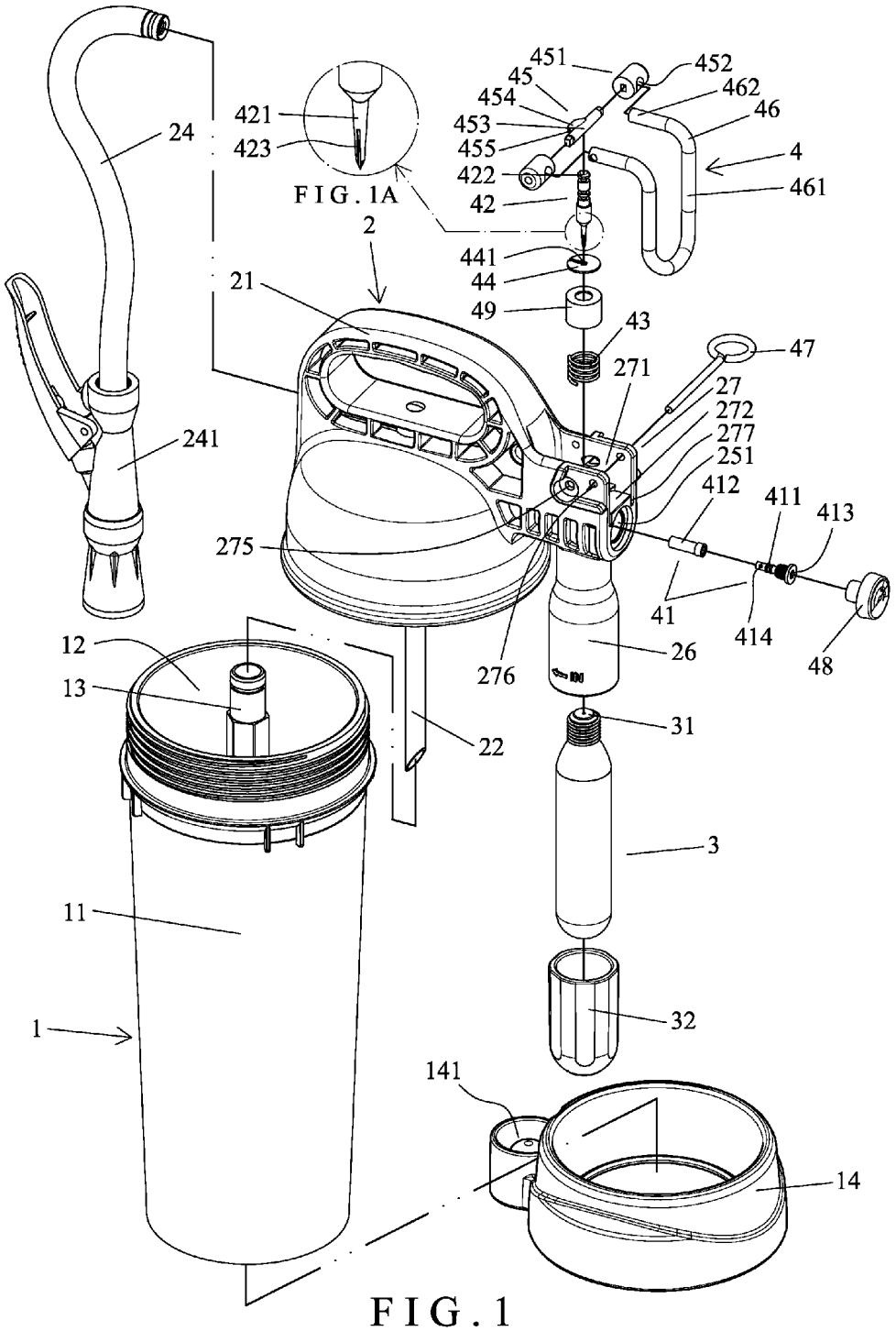
FIG. 1 is an exploded, perspective view of a fire extinguisher according to the present invention.
Figure 2:
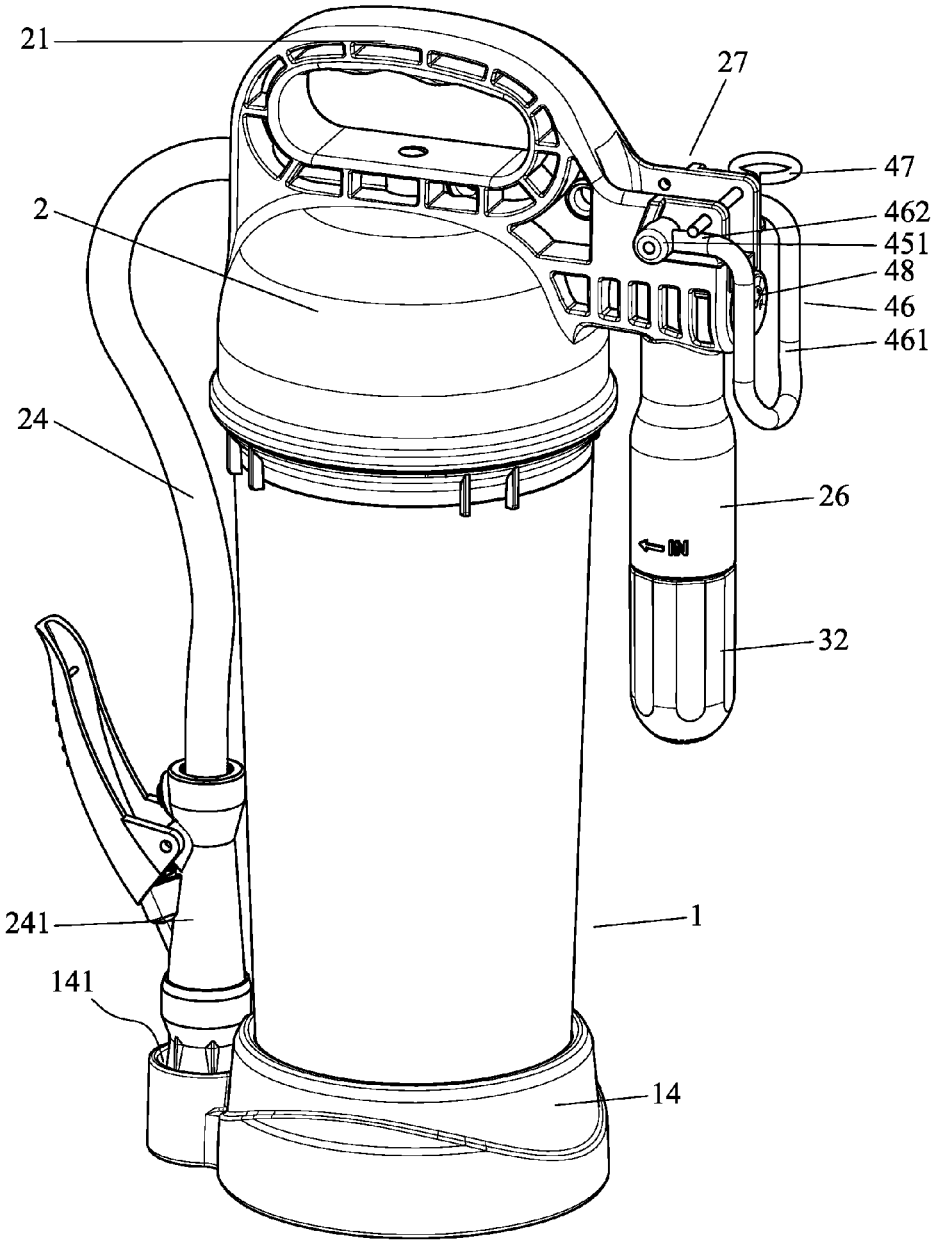
FIG. 2 is a perspective view of the fire extinguisher according to the present invention.

With reference to FIGS. 1-5, a fire extinguisher according to the present invention includes a body 1, an upper cover 2, a high-pressure steel bottle 3, and a gas intake control unit 4. The body 1 includes a chamber 11 for receiving fire extinguishing powders 5. The chamber 11 includes an opening 12 in an upper end of the body 1. A guiding tube 13 is mounted in a central portion of the chamber 11 and has an inlet 131 in a lower end thereof. A base 14 is mounted to a lower end of the body 1 and includes a holding groove 141.

The upper cover 2 covers the opening 12 of the body 1 and includes a handle 21 on an upper end thereof. Furthermore, the upper cover 2 includes an output passage 23 in communication with the chamber 11. The output passage 23 includes an outlet 231. An end of an output tube 24 is connected to the outlet 231, and a valve 241 is mounted in the output tube 24. When not in use, the other end of the output tube 24 is received in the holding groove 141.

The upper cover 2 further includes a gas inlet passage 25 extending in a horizontal direction of the body 1 and in communication with the chamber 11. The upper cover 2 further includes a first coupling portion 26 located below the gas inlet passage 25 in a vertical direction perpendicular to the horizontal direction. The first coupling portion 26 has a gas intake 261 in communication with the gas inlet passage 25. The gas inlet passage 25 includes an opening 251. The upper cover 2 further includes a second coupling portion 27 located above the gas intake 261 of the first coupling portion 26 in the vertical direction. In the embodiment shown, the second coupling portion 27 includes two sidewalls 271 parallel to each other and a bottom wall 272 extending between the parallel sidewalls 271. The bottom wall 272 of the second coupling portion 27 includes a through-hole 273 aligned with the gas intake 261. An annular groove 274 is provided around the through-hole 273. A pivotal hole 275 and a pin hole 276 are defined in each sidewall 271. Each pivotal hole 275 is located between one of the pin holes 276 and the body 1. The second coupling portion 27 further includes a drain 277 in front of the bottom wall 272. Water accumulated in the second coupling portion 27 can be drained via the drain 277.

The high-pressure steel bottle 3 includes a top end coupled to the first coupling portion 26. The high-pressure steel bottle 3 includes a preserved opening 31 aligned with the gas intake 261. A steel bottle cover 32 is provided below the high pressure steel bottle 3. The high-pressure steel bottle 3 is adapted to receive a high-pressure gas.

In the embodiment shown, the gas intake control unit 4 includes a check valve 41, a piercing needle 42, a spring 43, a stop 44, a pressing rod 45, a switch handle 46, a pin 47, a pressure gauge 48, and a dustproof sleeve 49. The check valve 41 is mounted in an inner side of the gas inlet passage 25 of the upper cover 2. The check valve 41 is adapted to prevent the gas from flowing through the gas inlet passage 25 in a reverse direction. The check valve 41 includes a rigid main body 411 and a soft sleeve 412 mounted around the main body 411. The main body 411 includes a gas inlet 413 in an axial direction. A gas outlet 414 is defined in a side of a rear end of the main body 411. The high pressure gas can be guided into the main body 411 via the gas inlet 413 and exits the main body 411 via the gas outlet 414 to expand the soft sleeve 412. Flow of the gas from the gas outlet 414 to the gas inlet 413 is prevented by the soft sleeve 412 covering the gas outlet 414.

The piercing needle 42 is mounted in the gas intake 261 of the first coupling portion 26 and the through-hole 273 of the second coupling portion 27. The piercing needle 42 includes a needle 421 on a bottom end thereof. The needle 421 is adapted to pierce into the preserved opening 31 of the high-pressure steel bottle 3. The piercing needle 42 further includes an abutment portion 422 on a top end thereof. The abutment portion 422 extends upward beyond the through-hole 273 of the second coupling portion 27. The needle 421 of the piercing needle 42 includes a recessed gas passage 423 in a side thereof.

The spring 43 includes a bottom end located in the annular groove 274 of the bottom wall 272 of the second coupling portion 27. The spring 43 further includes a top end abutting the stop 44. The stop 44 includes a through-hole 441 in a center thereof. The piercing needle 42 extends through the through-hole 441. The through-hole 441 of the stop 44 has a diameter smaller than a width of the abutment portion 422 of the piercing needle 42. The spring 43 abuts the stop 44 and the piercing needle 42, preventing the needle 421 from piercing into the preserved opening 31 of the high-pressure steel bottle 3 when the spring 43 is not compressed.

The pressing rod 45 includes two end seats 451 respectively mounted to outer sides of the sidewalls 271 of the second coupling portion 27 and aligned with the pivotal holes 275 of the sidewalls 271. Each end seat 45 includes a coupling groove 452. A shank 453 is mounted between the end seats 45 and includes two ends respectively extending through the pivotal holes 275 of the sidewalls 271 of the second coupling portion 27 and respectively coupled to the end seats 47. Thus, the pressing rod 45 is pivotably mounted to the second coupling portion 27. The shank 453 includes a pressing portion 454 for pressing against the abutment portion 422 of the piercing needle 42. The pressing portion 454 of the shank 453 includes an arcuate side 455 on an outer edge thereof for actuating the piercing needle 42.

The switch handle 46 includes a holding portion 461 located outside of the upper cover 2. The switch handle 46 further includes two side portions 462 respectively coupled to the coupling grooves 452 of the end seats 45 of the pressing rod 45. Thus, the switch handle 46 is operably connected to the end seats 452 of the pressing rod 45, with the holding portion 461 spaced from the shank 453 of the pressing rod 45. The side portions 462 of the switch handle 46 are normally located below the pin holes 276. The pin 47 extends through the pin holes 276 and is located above the side portions 62 of switch handle 46 to restrain movement of the switch handle 46.

The pressure gauge 48 is mounted in and seals the opening 251 of the gas inlet passage 25. The dustproof sleeve 49 is made of soft material. The dustproof sleeve 49 is annular and located between the stop 44 and the bottom wall 272 of the second coupling portion 27. The spring 43 is surrounded by the dustproof sleeve 49 to prevent dust from adhering to the spring 43, assuring smooth operation even after a long period of time.

When the switch handle 46 is not pulled, the spring 43 holds the piercing needle 42 such that needle 421 of the piercing needle 42 will not pierce into the preserved opening 31 of the high-pressure steel bottle 3. When the pin 47 is not removed, even if the switch handle 46 is pulled, the side portions 462 of the switch handle 46 press against the pin 47 to avoid pulling of the switch handle 46, reliably preventing the piercing needle 42 from moving downward to pierce into the preserved opening 31 of the high-pressure steel bottle 3. In this case, the pressure reading of the pressure gauge 48 is zero.

Figure 3:
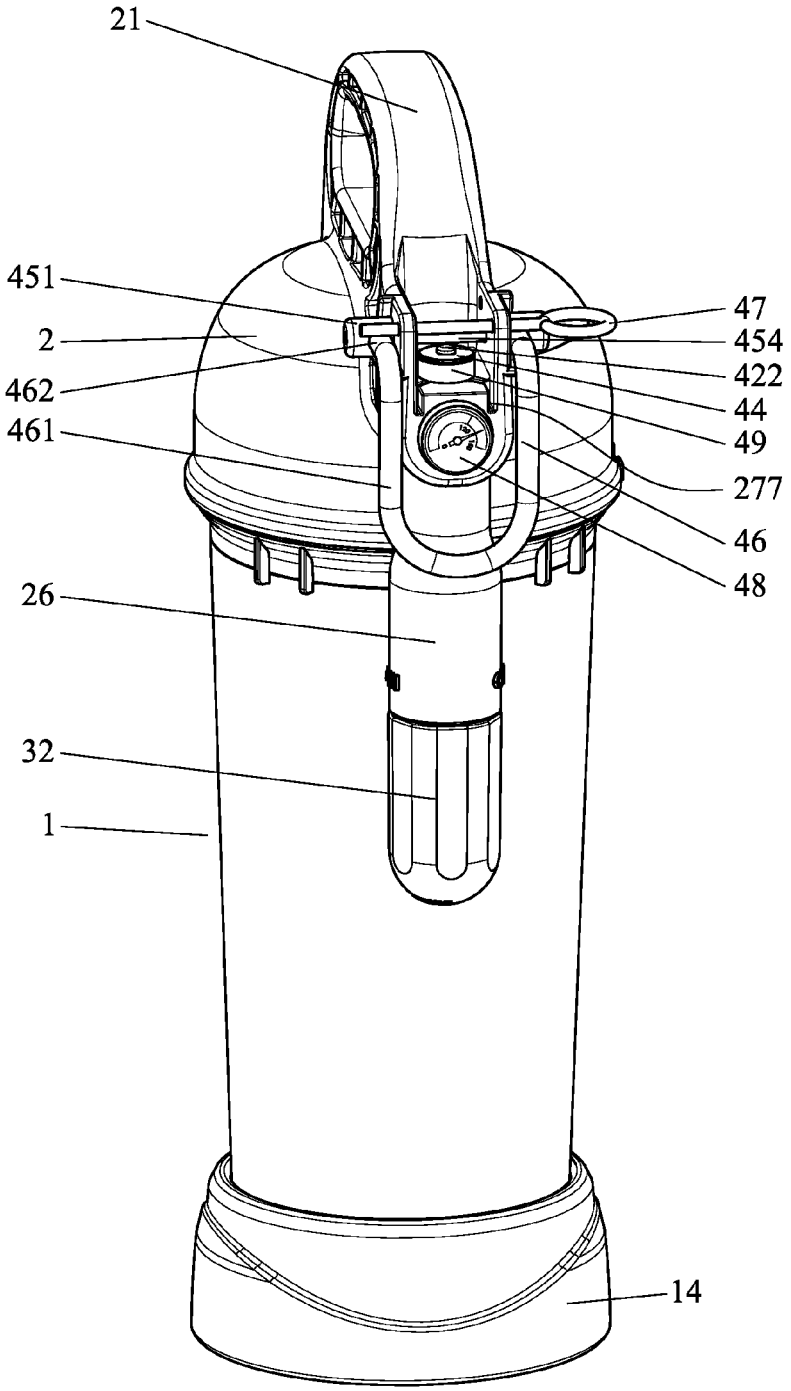
FIG. 3 is another perspective view of the fire extinguisher according to the present invention.
Figure 4:
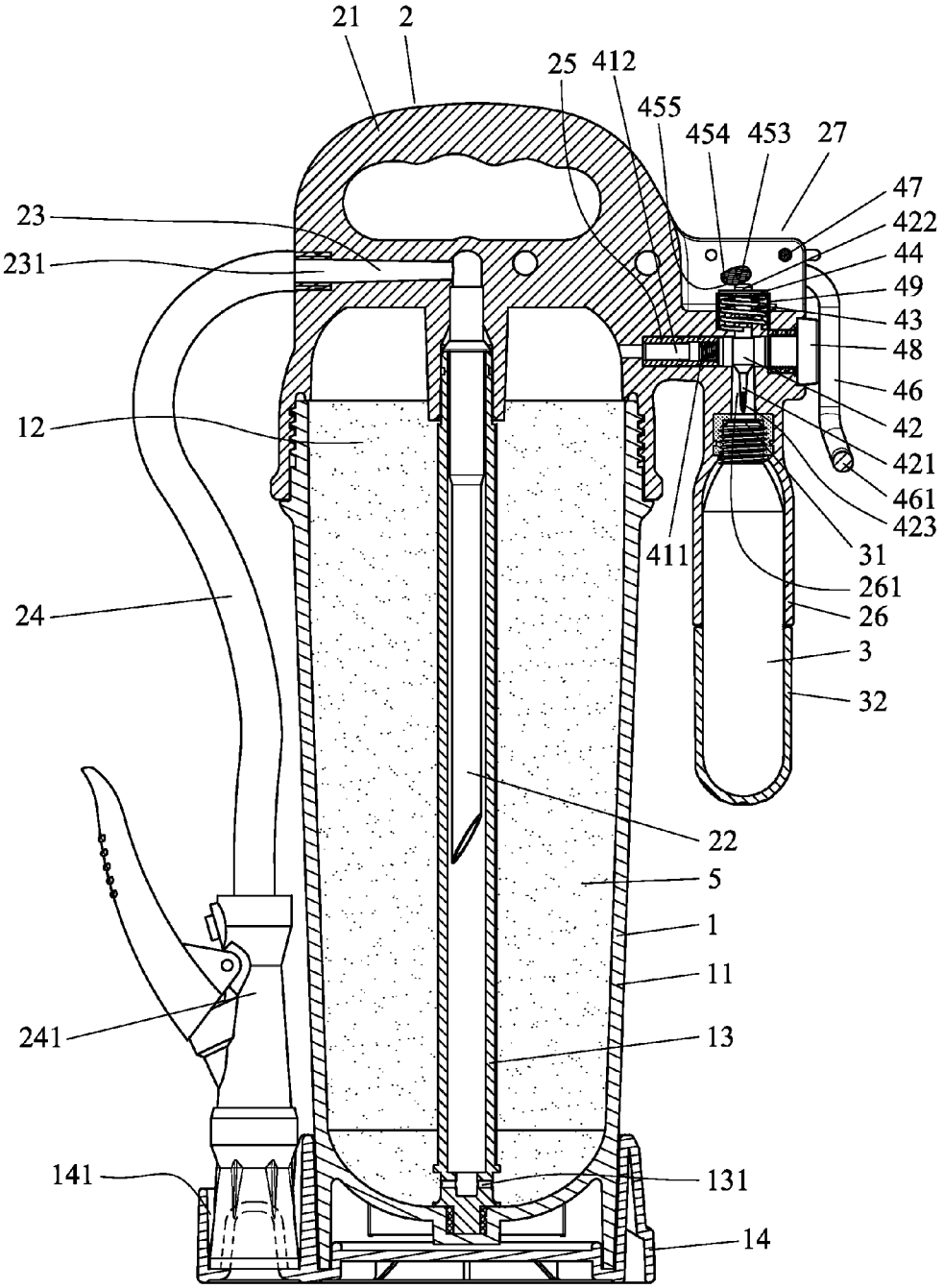
FIG. 4 is a cross sectional side view of the fire extinguisher according to the present invention.
Figure 5:
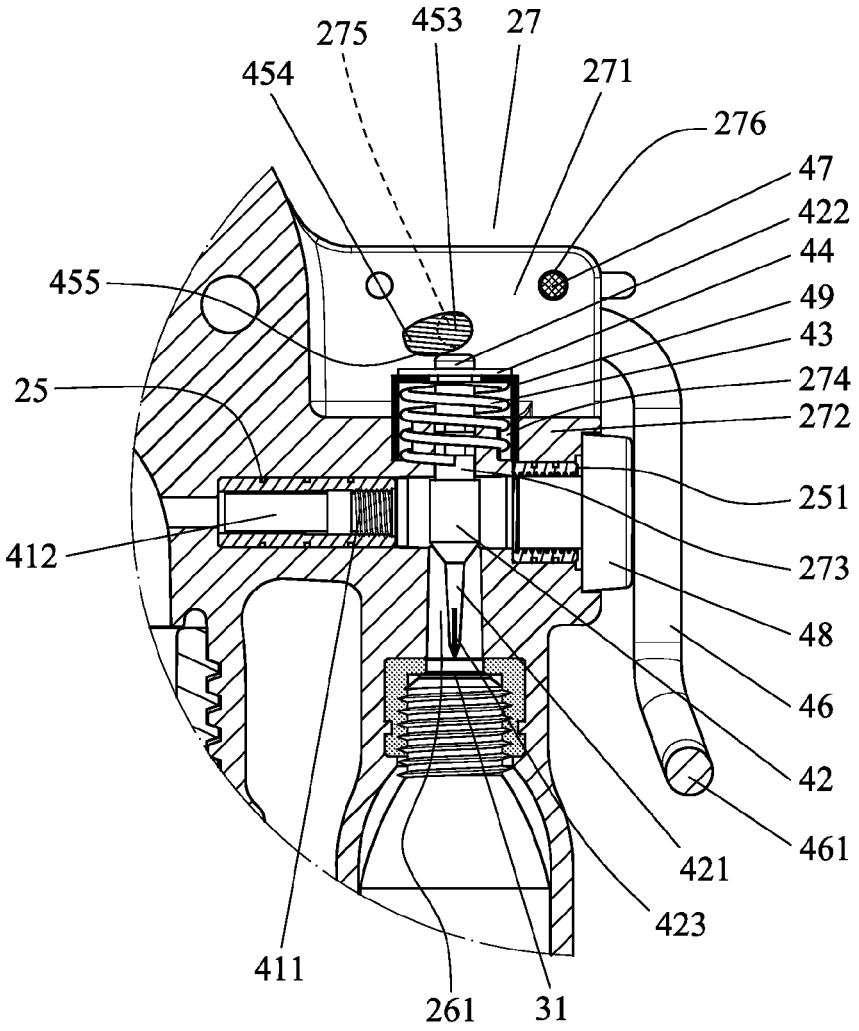
FIG. 5 is an enlarged view of a portion of the fire extinguisher according to the present invention, with a switch handle not pulled.

With reference to FIG. 3, when a user removes the pin 47 and pulls the switch handle 46 to drive the pressing rod 45 to pivot, the pressing portion 454 presses against the abutment portion 422 of the piercing needle 42 and, thus, moves the piercing needle 42 downward, such that the needle 421 of the piercing needle 42 pierces into the preserved opening 31 of the high-pressure steel bottle 3. The high-pressure gas is guided out of the high-pressure steel bottle 3 via the recessed gas passage 423. The above operation can simply be achieved by applying a small force to the holding portion 461 distant to the piercing needle 42 to complete actuation of the piercing needle 42 by the pressing rod 45. A force-saving lever effect is provided while assuring that an ordinary user can pierce the high-pressure steel bottle 3. When the switch handle 46 is released, the spring 43 returns the piercing needle 42 to its original position.

Figure 6:
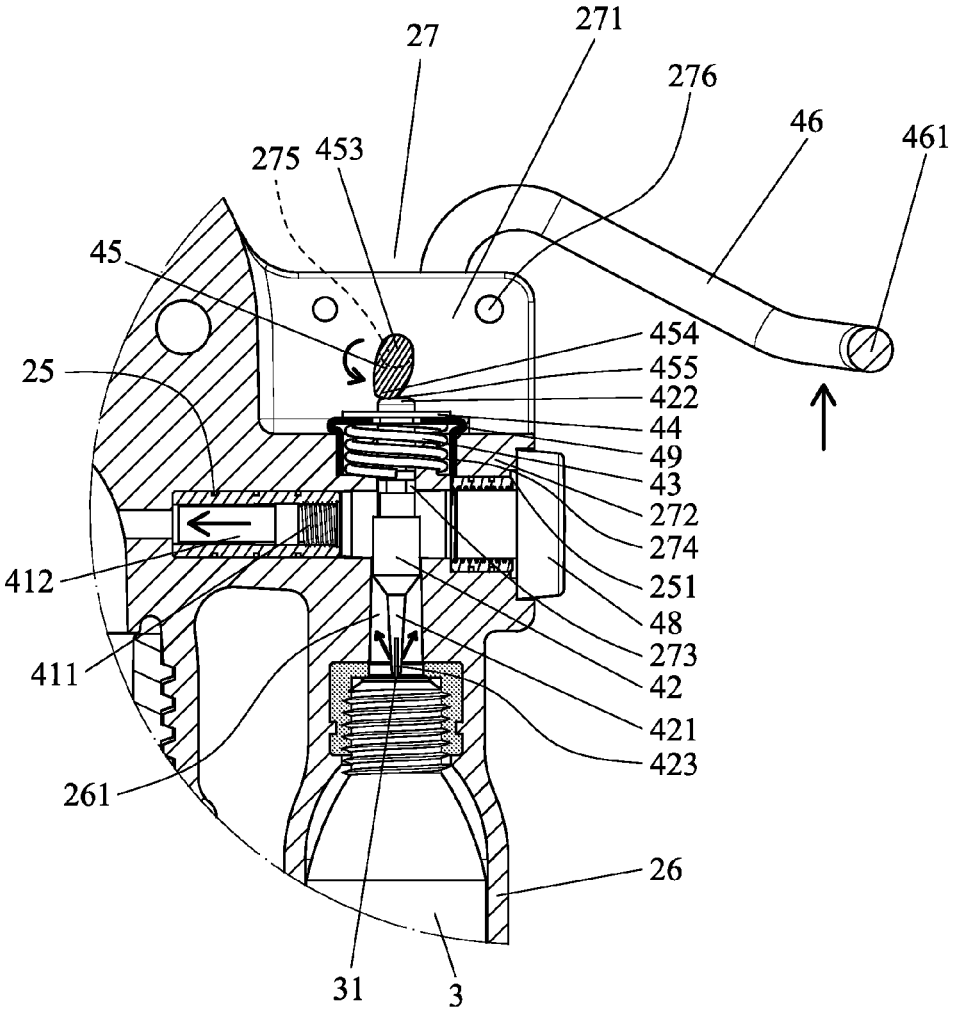
FIG. 6 is a view similar to FIG. 5, with the switch handle pulled.
Figure 7:
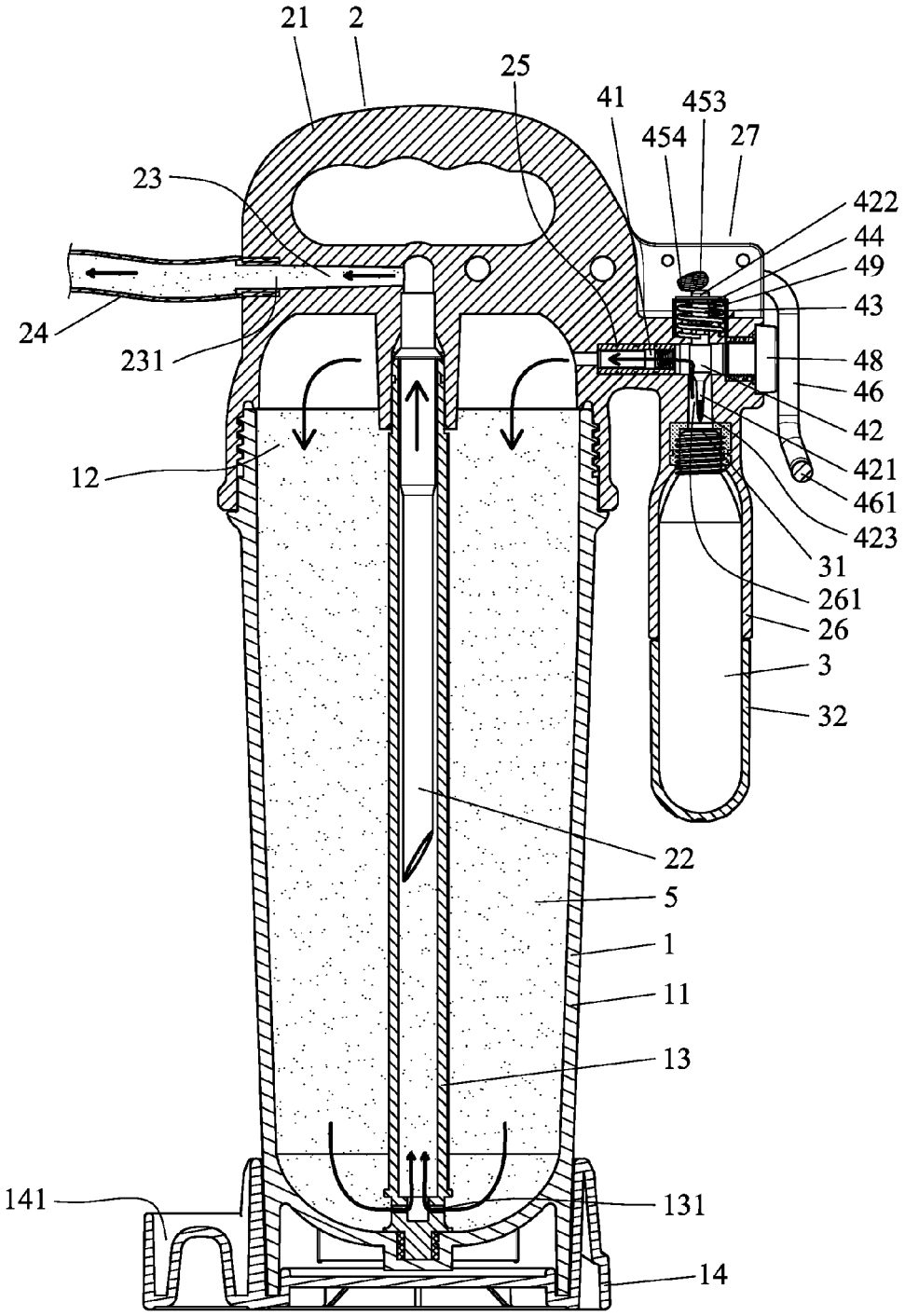
FIG. 7 is a cross sectional view of the fire extinguisher according to the present invention, with the switch handle pulled to output fire extinguishing powders.

With reference to FIGS. 6 and 7, the high pressure gas in the high-pressure steel bottle 3 passes through the check valve 41 in the gas inlet passage 25 and enters the chamber 11 of the body 1. The recessed gas passage 423 assures that the high pressure gas can enter the gas inlet passage 25 no matter the piercing needle 42 returns to a position shown in FIG. 7, providing reliable use. The pressure in the body 1 can be observed from the pressure gauge 48. Furthermore, the high pressure gas carries the fire extinguishing powders 5 in the body 1 through the guiding tube 13, the inner tube 22, and the output tube 24 for extinguishing the fire. The handle 21 is located on the upper end of the upper cover 2 and corresponds to the location of the center of gravity, allowing the user to easily hold the handle 21 while putting out the fire. Thus, the fire extinguisher according to the present invention possesses safety and provides a force-saving effect.

After use, the upper cover 2 can be detached from the body 1 for refilling the fire extinguishing powders 5. Another high-pressure steel bottle 3 can be attached to the first coupling portion 26, allowing repeated use of the fire extinguisher. An ordinary user can easily accomplish the detachment without special tools, providing convenient repeated use. It can be appreciated that other types of check valves can be used.

Although specific embodiments have been illustrated and described, numerous modifications and variations are still possible without departing from the scope of the invention. The scope of the invention is limited by the accompanying claims.

The invention claimed is:

1. A fire extinguisher comprising:

a body including a chamber having an opening in an upper end of the body, with the chamber adapted to receive fire extinguishing powders;

an upper cover covering the opening of the body, with the upper cover including an output passage in communication with the chamber, with the upper cover further including a gas inlet passage in communication with the chamber, with the upper cover further including a first coupling portion having a gas intake in communication with the gas inlet passage, with the upper cover further including a second coupling portion, with the second coupling portion including a through-hole aligned with the gas intake, with the second coupling portion further including at least one pivot hole and at least one pin hole;

a high-pressure steel bottle including a top end coupled to the first coupling portion, with the high-pressure steel bottle adapted to receive a high pressure gas, and with the high-pressure steel bottle including a preserved opening aligned with the gas intake; and a gas intake control unit including:

a check valve mounted in the gas inlet passage of the upper cover, with the check valve adapted to prevent the gas from flowing through the gas inlet passage in a reverse direction;

a piercing needle mounted in the gas intake of the first coupling portion and the through-hole of the second coupling portion, with the piercing needle including a needle on a bottom end thereof, with the needle adapted to pierce into the preserved opening of the high-pressure steel bottle, with the piercing needle further including an abutment portion on a top end thereof, and with the abutment portion extending upward beyond the through-hole of the second coupling portion;

a spring holding the piercing needle such that the needle of the piercing needle will not pierce into the preserved opening of the high-pressure steel bottle when the spring is not compressed;

a pressing rod including a shank pivotably connected to the at least one pivotal hole of the second coupling portion, with the shank including a pressing portion for pressing against the abutment portion of the piercing needle;

a switch handle including a holding portion located outside of the upper cover, with the switch handle further including at least one side portion operably connected to the pressing rod, with the holding portion spaced from the shank of the pressing rod;

a pin extending through the at least one pin hole, with the pin restraining movement of the switch handle, wherein if the pin is removed, when the holding portion of switch handle is operated to drive the pressing rod to pivot, the piercing needle is actuated by the pressing portion to pierce into the preserved opening of the high-pressure steel bottle.

2. The fire extinguisher as claimed in claim 1, with the gas inlet passage of the upper cover extending in a horizontal direction of the body, with the first coupling portion located below the gas inlet passage in a vertical direction perpendicular to the horizontal direction, with the second coupling portion located above the gas intake of the first coupling portion in the vertical direction, with the second coupling portion including two sidewalls parallel to each other and a bottom wall extending between the two sidewalls, with the through-hole of the second coupling portion located in the bottom wall, with the at least one pivotal hole including two pivotal holes respectively located in the two sidewalls, with the at least one pin hole including two pin holes respectively located in the two sidewalls, and with each of the two pivotal holes located between one of the two pin holes and the body.

3. The fire extinguisher as claimed in claim 2, with the pressing portion of the pressing rod including an arcuate side on an outer edge thereof, and with the needle of the piercing needle including a recessed gas passage in a side thereof.

4. The fire extinguisher as claimed in claim 2, with the gas intake control unit further including a stop, with the spring including a bottom end abutting the bottom wall of the second coupling portion, with the spring further including a top end abutting the stop, with the stop including a through-hole through which the piercing needle extends, with the through-hole of the stop having a diameter smaller than a width of the abutment portion of the piercing needle, with the spring abutting the stop and the piercing needle, preventing the needle from piercing into the preserved opening of the high-pressure steel bottle when the spring is not compressed.

5. The fire extinguisher as claimed in claim 4, further comprising: a dustproof sleeve made of soft material, with the dustproof sleeve being annular and located between the stop and the bottom wall of the second coupling portion, and with the spring surrounded by the dustproof sleeve.

6. The fire extinguisher as claimed in claim 2, with the pressing rod further including two end seats respectively mounted to outer sides of the two sidewalls of the second coupling portion and aligned with the two pivotal holes of the two sidewalls of the second coupling portion, with each of the two end seats including a coupling groove, with the shank including two ends respectively extending through the two pivotal holes of the two sidewalls of the second coupling portion and respectively coupled to the two end seats, with the at least one side portion of the switch handle including two side portions respectively coupled to the coupling grooves of the two end seats, with the two side portions of the switch handle normally located below the two pin holes, and with the pin located above the switch handle.

7. The fire extinguisher as claimed in claim 6, with the gas inlet passage including an opening, and with the gas intake control unit further including a pressure gauge mounted in and sealing the opening of the gas inlet passage.

8. The fire extinguisher as claimed in claim 6, with the body further including a guiding tube mounted in a central portion of the chamber, with the guiding tube including a lower end having an inlet, with the upper cover including an inner tube in a lower end thereof, with the inner tube in communication with the guiding tube, with the output passage of the upper cover in communication with the inner tube and the chamber, with the output passage including an outlet, with an output tube having an end connected to the outlet, and with a valve mounted in the output tube.

9. The fire extinguisher as claimed in claim 2, with the upper cover further including a handle on an upper end thereof.

10. The fire extinguisher as claimed in claim 2, with the second coupling portion further including a drain in front of the bottom wall.

* * * * *